US010870520B2

(12) United States Patent
Herling et al.

(10) Patent No.: US 10,870,520 B2
(45) Date of Patent: Dec. 22, 2020

(54) DRINKING CONTAINER WITH PIVOTING CLOSURE

(71) Applicant: Marc Heinke, Oakville (CA)

(72) Inventors: Nicholas Herling, Oakville (CA); Marc Heinke, Oakville (CA)

(73) Assignee: Marc Heinke, Oakville (CA)

( * ) Notice: Subject to any disclaimer, the term of this patent is extended or adjusted under 35 U.S.C. 154(b) by 0 days.

(21) Appl. No.: 16/026,576

(22) Filed: Jul. 3, 2018

(65) Prior Publication Data

US 2020/0010250 A1 Jan. 9, 2020

(51) Int. Cl.

| | |
|---|---|
| ***B65D 43/16*** | (2006.01) |
| ***B65D 41/16*** | (2006.01) |
| ***B65D 47/06*** | (2006.01) |
| ***B65D 85/80*** | (2006.01) |

(52) U.S. Cl.

CPC ..... *B65D 43/164* (2013.01); *B65D 41/16* (2013.01); *B65D 47/066* (2013.01); *B65D 85/80* (2013.01)

(58) Field of Classification Search

CPC ..... B65D 47/066; B65D 47/08; B65D 2251/1058; B65D 2251/1066; A47G 19/2272

USPC ..... 220/254.5, 292, 787, 789, 823, 827

See application file for complete search history.

(56) References Cited

U.S. PATENT DOCUMENTS

| | | | | |
|---|---|---|---|---|
| 3,278,009 | A | 10/1966 | Crump | |
| 4,682,707 | A * | 7/1987 | Wiles | B65D 43/0272 138/89 |
| 5,107,990 | A | 4/1992 | Wicherski et al. | |
| 6,279,773 | B1 | 8/2001 | Kiyota | |
| D584,102 | S | 1/2009 | Valderrama et al. | |
| 7,926,653 | B2 | 4/2011 | Tawada et al. | |
| 9,616,563 | B2 * | 4/2017 | Vilkormirski | B25H 3/023 |
| 2005/0115967 | A1 | 6/2005 | Conaway | |
| 2009/0283526 | A1 * | 11/2009 | Pierce | A47G 19/22 220/254.7 |
| 2011/0226772 | A1 | 9/2011 | Adler et al. | |

(Continued)

FOREIGN PATENT DOCUMENTS

| | | | |
|---|---|---|---|
| CA | 2743812 | A1 | 12/2012 |
| CA | 2783305 | A1 | 8/2013 |

(Continued)

OTHER PUBLICATIONS

Asobu, "The Juicy Drink Box—JB300", May 12, 2016, retrieved Sep. 18, 2017 at: http://www.asobubottle.com/product/61.html (1 page).

(Continued)

*Primary Examiner* — Don M Anderson

(57) ABSTRACT

A drinking container comprises a vessel; a cap, atop the vessel; a lid; and a hinge located proximate a rear of the lid and interconnecting the cap to the lid, to allow the lid to pivot on the cap between a closed and open position. A locking tab is at the front of the lid that engages with an inner surface of the cap, to retain the lid in the closed position. A first abutment surface is on the cap and a second abutment surface is on the lid. The first and second abutment surfaces are arranged to contact with each other as the lid is pivoted from the open position to the closed position. Contact of the first and second abutment surfaces urges the lid and the tab forward as the lid is pivoted to the closed position.

15 Claims, 12 Drawing Sheets

(56) References Cited

U.S. PATENT DOCUMENTS

| | | | | |
|---|---|---|---|---|
| 2012/0312816 | A1 | 12/2012 | Barreto et al. | |
| 2012/0312832 | A1* | 12/2012 | Lane | B65D 47/066 220/833 |
| 2013/0048637 | A1* | 2/2013 | Brandenburger | B65D 41/0442 220/212 |
| 2013/0134175 | A1* | 5/2013 | O'Hara | B60K 15/00 220/827 |
| 2014/0175042 | A1 | 6/2014 | Lane | |
| 2016/0200485 | A1* | 7/2016 | Quinones | B65D 43/24 220/254.5 |
| 2017/0015474 | A1* | 1/2017 | Szekely | B65D 47/08 |
| 2017/0208974 | A1* | 7/2017 | Zhang | A47G 21/18 |

FOREIGN PATENT DOCUMENTS

| | | | |
|---|---|---|---|
| CN | 203111801 | U | 8/2013 |
| EP | 2532601 | A1 | 12/2012 |
| WO | 2008131437 | A1 | 10/2008 |

OTHER PUBLICATIONS

Nathan Sports, "Flip-Straw Frosted Titan", May 14, 2016, retrieved Sep. 18, 2017at http://www.nathansports.com/hydration/bottles-flasks/flip-straw-frosted-tritan (2 pages).

"Plain Silver Tins", http://www.copybook.com/packaging/companies/the-box-bv/articles/plain-silver-tins; Jan. 27, 2012, (3 pages).

"Juice 2 Go—Noodle Soup", http://www.noodlesoup.com/juice2go.aspx, Sep. 25, 2015 (2 pages).

Partial European Search Report dated Oct. 25, 2017 in relation to European Patent Application No. 17176315.4, filed Jun. 16, 2017 (13 pages).

* cited by examiner

FIG. 4A
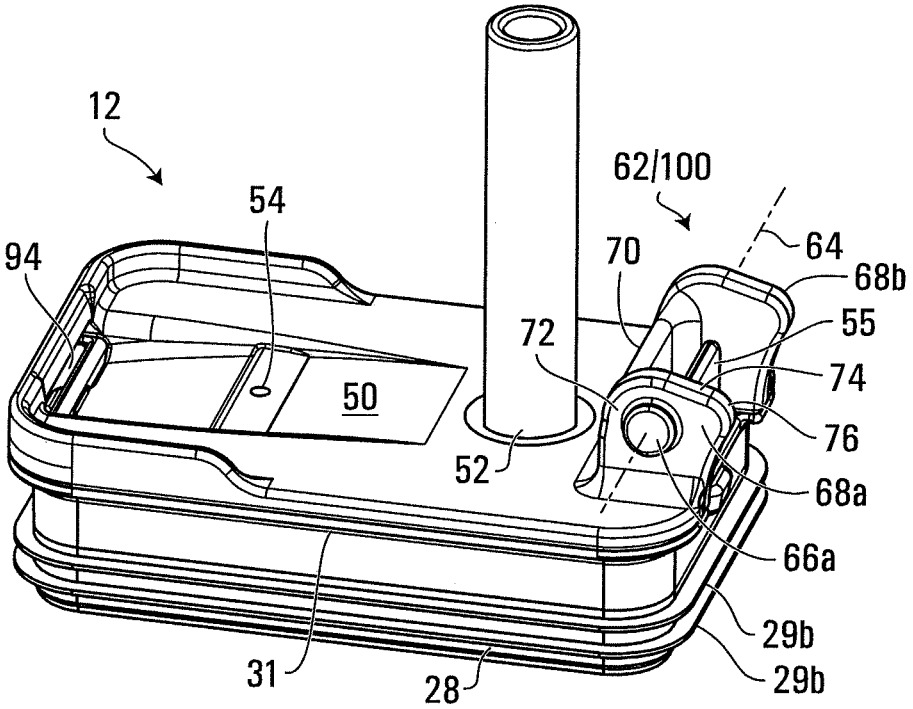
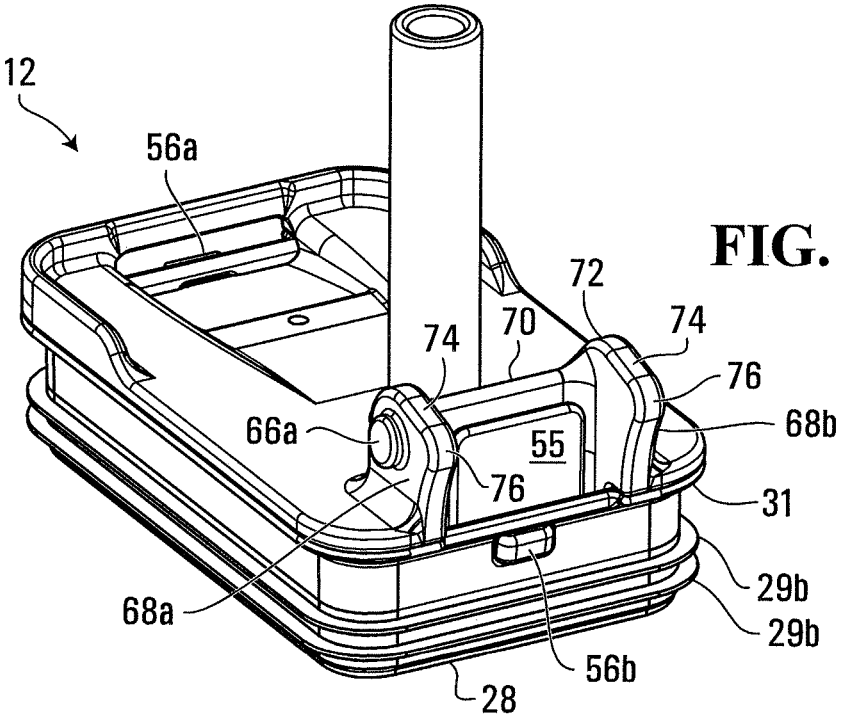
FIG. 4B

DRINKING CONTAINER WITH PIVOTING CLOSURE

TECHNICAL FIELD

This relates to drinking containers, and more particularly drinking containers with pivoting closures.

BACKGROUND

In the modern age, transporting food and drink for consumption is typical.

A variety of food and beverage containers are therefore known. Many beverage/drinking containers, however, do not adequately keep liquid from spilling. Others are hard to open. Yet others are mechanically complex, and expensive to manufacture.

Accordingly, there remains a need for new drinking containers.

SUMMARY

According to an aspect, a drinking container comprises a vessel; a cap, atop the vessel; a lid; a hinge located proximate a rear of the lid and interconnecting the cap to the lid, to allow the lid to pivot on the cap between a closed and open position; and a locking tab at the front of the lid, that engages with an inner surface of the cap, to retain the lid in the closed position. A first abutment surface is on the cap and a second abutment surface is on the lid. The first and second abutment surfaces are arranged to contact with each other as the lid is pivoted from the open position to the closed position. Contact of the first and second abutment surfaces urges the lid and the tab forward as the lid is pivoted to the closed position.

According to another aspect, a drinking container lid assembly includes, a cap; a lid; a hinge located proximate a rear of the lid and interconnecting the cap to the lid, to allow the lid to pivot on the cap between a closed and open position; and a locking tab at the front of the lid, that engages with an inner surface of the cap, to retain the lid in the closed position. The hinge comprises at least one hinge pin mounted in an oblong opening to allow pivoting of the lid, and sliding of the lid on the cap to allow the locking tab to be disengaged from the inner surface of the cap.

Other features will become apparent from the drawings in conjunction with the following description.

BRIEF DESCRIPTION OF THE DRAWINGS

In the figures which illustrate example embodiments,

FIGS. 4A-4B are perspective views of a cap and straw assembly of the drinking container of FIG. 1;

DETAILED DESCRIPTION

Figure 1:
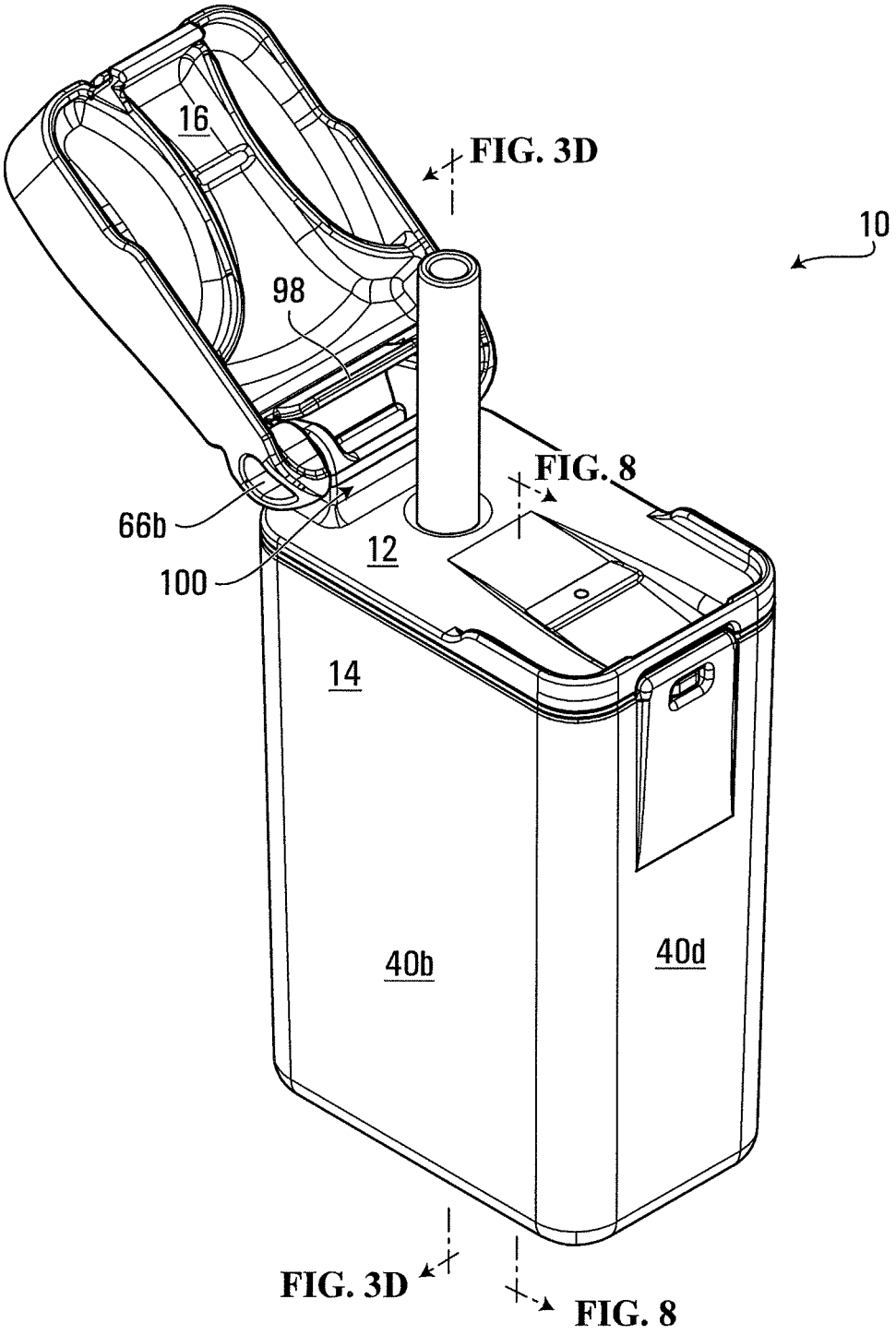
FIG. 1 is a perspective view of a drinking container, with lid open, exemplary of an embodiment.

FIG. 1 is a perspective view of a drinking container 10, exemplary of an embodiment. Container 10 is generally intended for transporting a quantity of potable liquid, for example in the form of juice, milk, water or the like for consumption on the go.

Figure 3A:
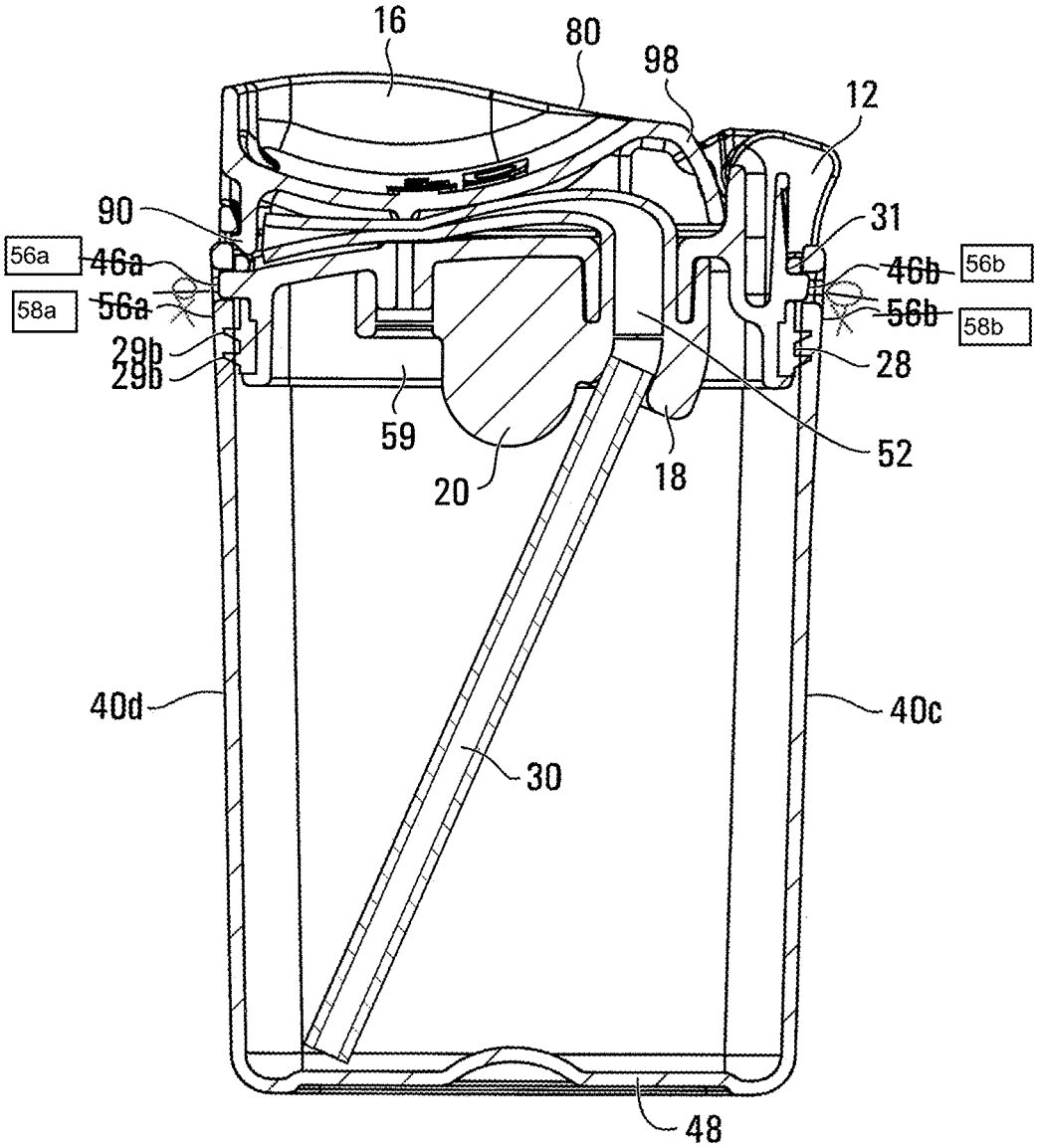
FIG. 3A-3D are cross-sectional views of FIGS. 2A-2D.
Figure 3B:
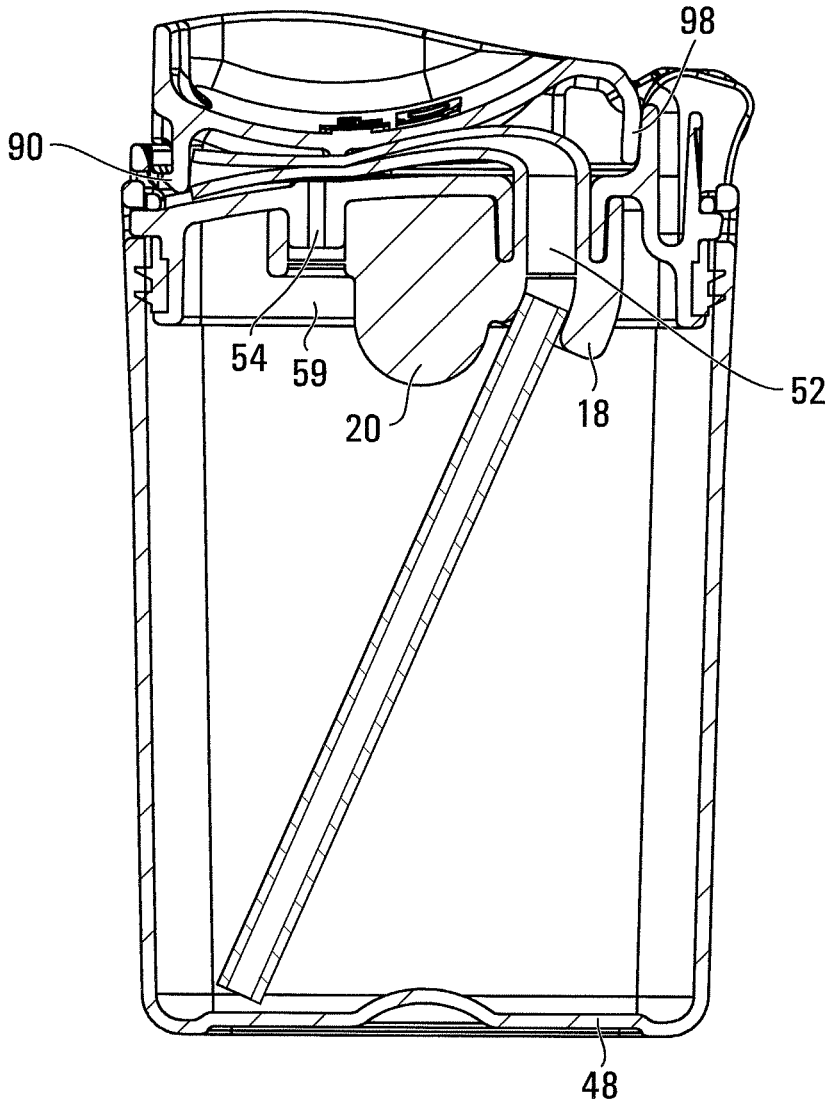
Figure 3C:
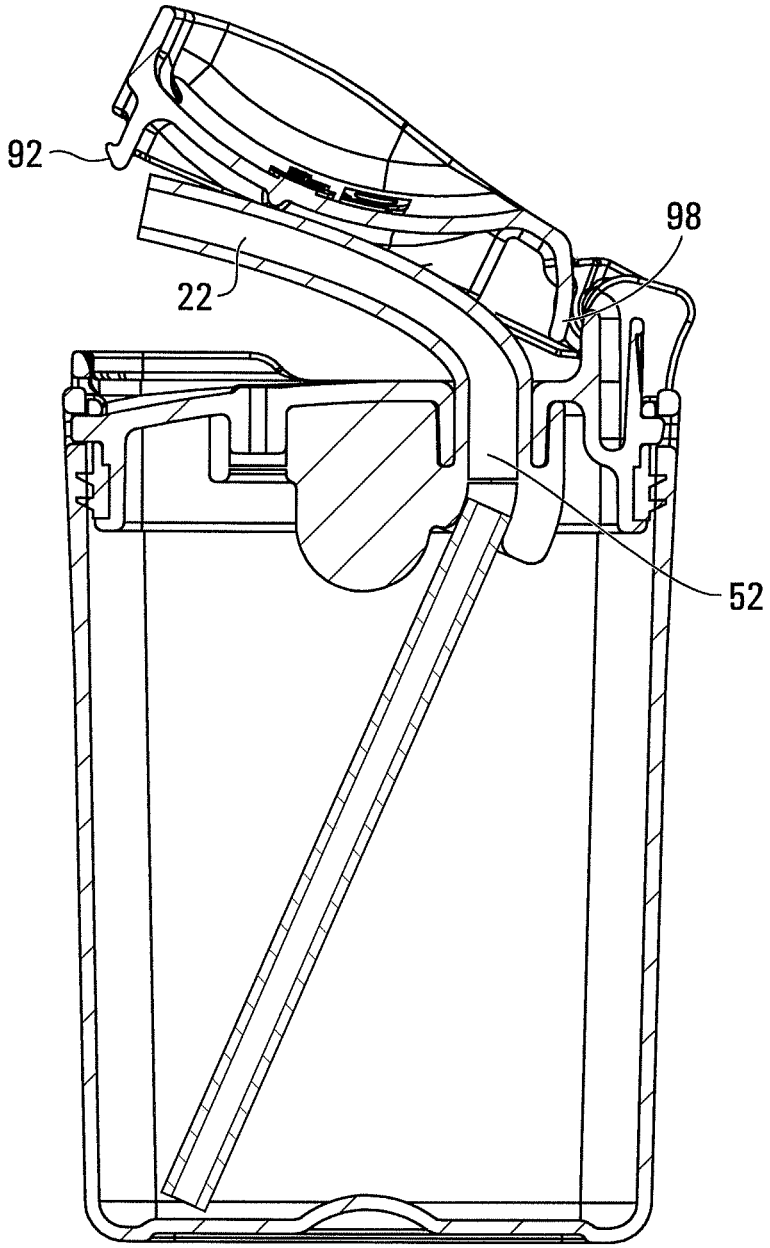
Figure 3D:
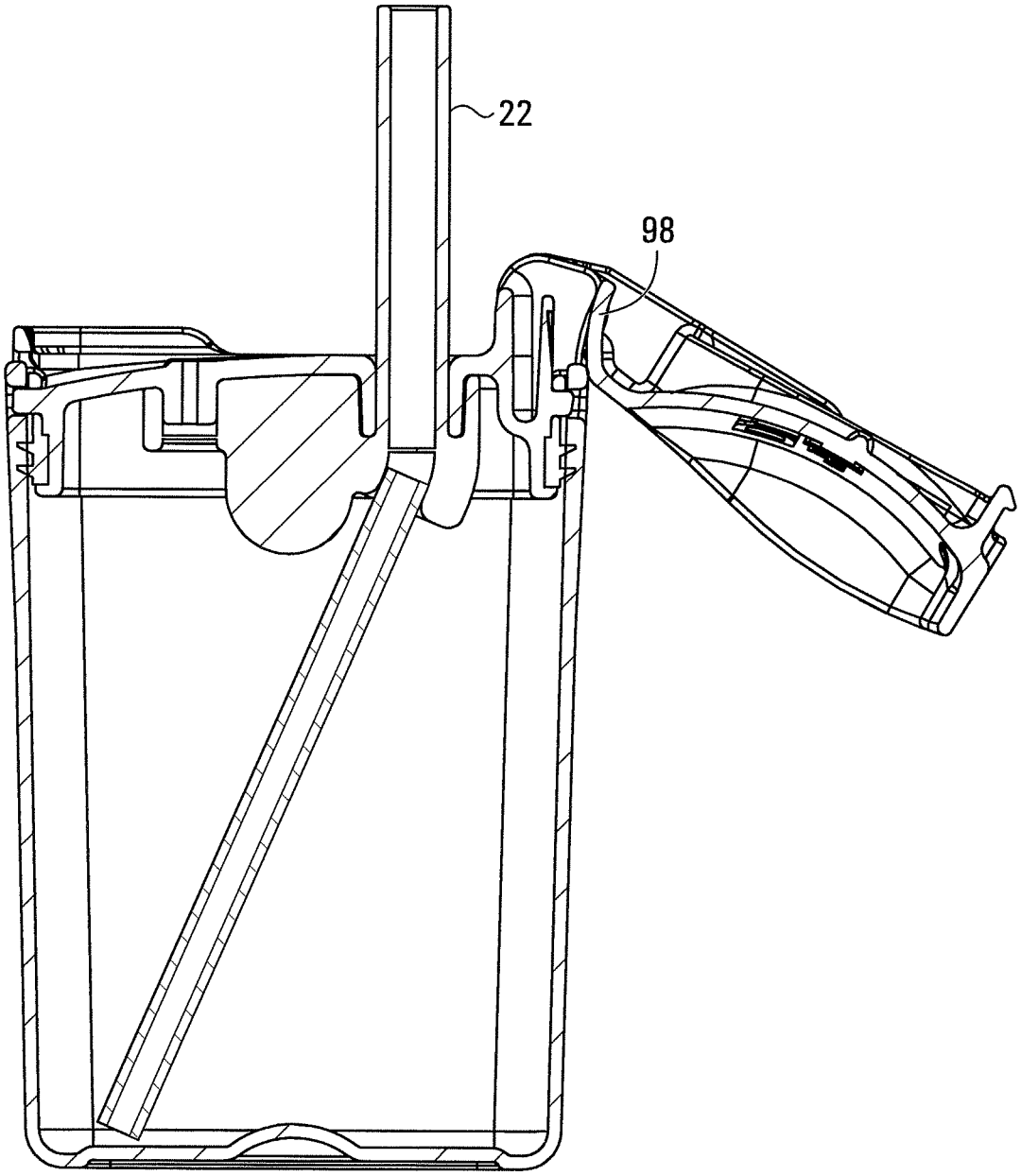

To that end, and as illustrated, container 10 includes vessel 14 defining an interior cavity for storing the liquid. A sub-assembly formed of a container cap 12, straw assembly 18 (visible in FIGS. 3A and 3B) and lid 16 may be placed atop of a full vessel 14 for transport and dispensing of liquid.

Cap 12 engages and closes the top opening of a vessel 14. Cap 12 is shaped to conform to the upper opening of vessel 14.

In FIG. 1, lid 16 is in an open position. As will become apparent, lid 16 may be pivoted between its open and closed position on hinge 100.

Figure 6:
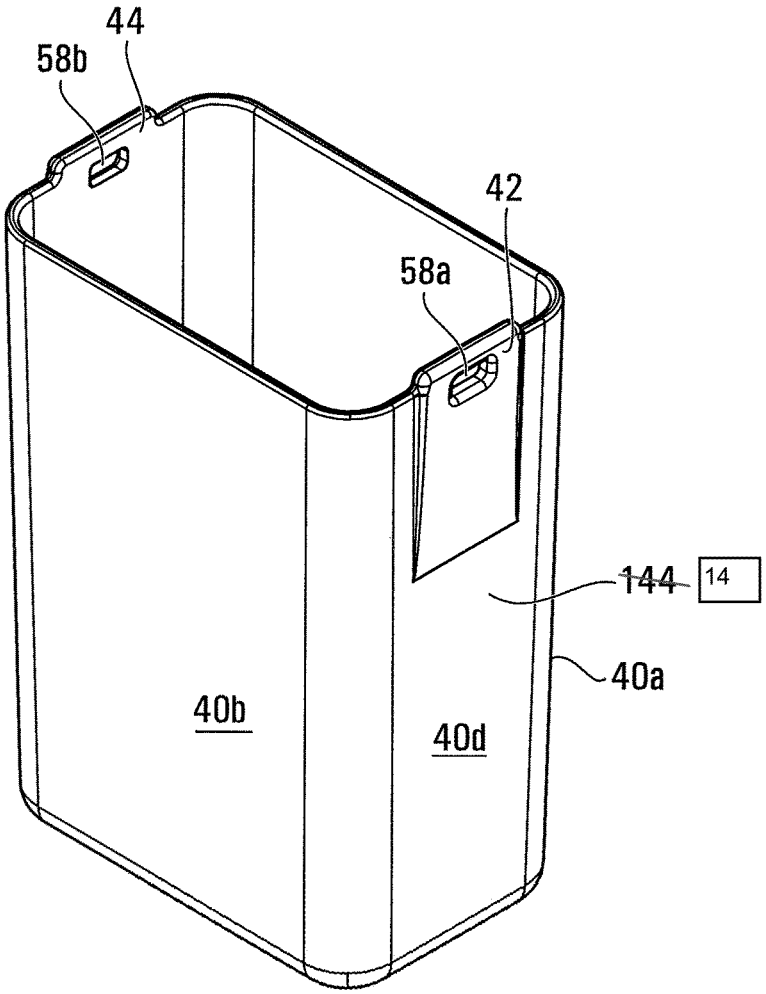
FIG. 6 is a perspective view of a drinking vessel of the drinking container of FIG. 1.
Figure 7:
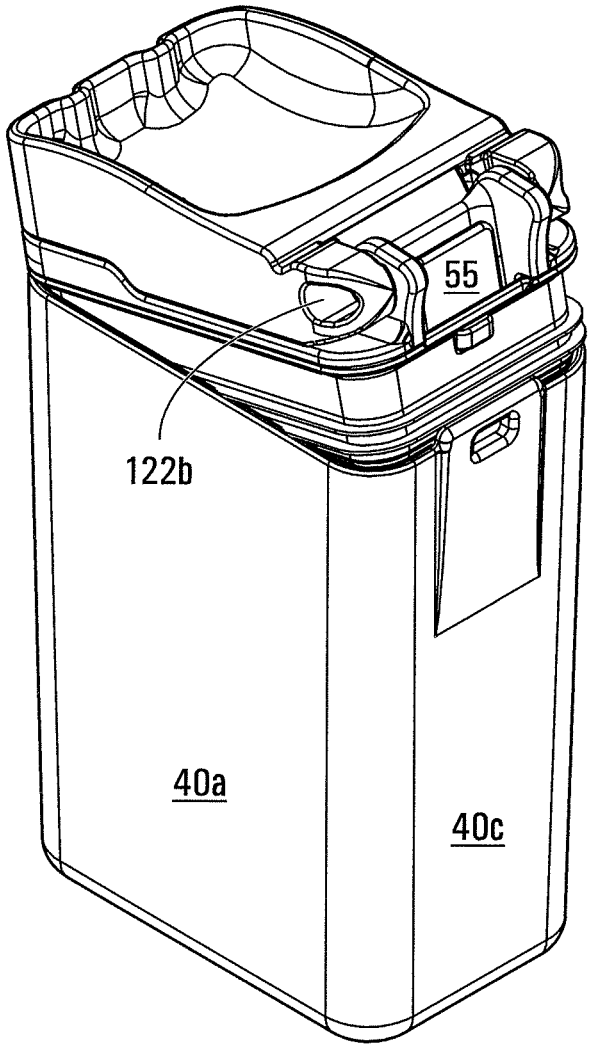
FIG. 7 is a perspective view of the drinking container of FIG. 1, as its cap is being removed.

Vessel 14 is best viewed in FIGS. 2A-2D and in isolation in FIG. 6. As illustrated, vessel 14 is generally rectangular, and includes four upwardly extending walls—two opposing side walls 40*a*, 40*b* and a front and a rear wall 40*d* and 40*c*, extending from a generally flat bottom base 48. Front wall 40*d* includes an upwardly extending front tab 42, and an engagement notch/hole 58*a* (best viewed in FIG. 6). Rear wall 40*d* similarly includes an upwardly extending aft tab 44 with an engagement hole 58*b*. Front and aft tabs 42, 44 extend upwardly above a top edge of walls 40*a* and 40*b*. The interface between side walls 40*a*, 40*b*, and rear and front walls 40*c*, 40*d* may be bevelled, as illustrated. Other geometries are of course possible. For example, vessel 14 might be in the form of a cube; a circular or oval cylinder; or the like.

Vessel 14 may be made of a hard or semi-hard plastic, and may be transparent, translucent or opaque. Vessel 14 may be formed using traditional moulding techniques, including plastic blow or injection moulding.

Drinking straw assembly 18 extends from container cap 12. Drinking straw assembly 18 includes a base 20 for interconnection with cap 12, and a flexible straw 22 in fluid communication with a straw 30, and thereby the interior of vessel 14, as best viewed in FIGS. 3A-3D.

With cap 12 in place on vessel 14, straw 30 extends from flexible straw 22 and from cap 12 into vessel 14 and through its top opening. Straw 30 preferably extends to the bottom of vessel 14 to allow vessel 14 to be emptied there through. Straw 30 may be removable from vessel 14, and may be formed of plastic or silicone.

Flexible straw 22 surrounds the tip of straw 30. These may be coaxial. Flexible straw 22 thereby allows liquid to be withdrawn from vessel 14 via straw 30 and flexible straw 22. Base 20 may be formed of rubber, and may be friction fit into a complementary opening in cap 12. Flexible straw 22 extends generally upwardly, but may be bent forward or backward. Its natural tendency will be to resile into an upward orientation. Conveniently, flexible straw 22 may extend at a suitable angle from base 20, so that straw 30, when inserted therein rests against the front edge of the base of vessel 14. Of course, the length of straw 30 may be dimensioned adequately to intersect with the front edge of the base of vessel 14.

A seal 28 (also visible in FIGS. 4A and 4B) seals container cap 12 to vessel 14. Seal 28 conforms to the interior edge of the upper opening of vessel 14, and is interposed between cap 12 and vessel 14. Seal 28 may be formed of a flexible polymer, rubber or the like. Seal 28 may include one or more outwardly extending ribs 29*a*, 29*b* that further bind seal 28 to vessel 14, and provide a liquid impervious seal between cap 12 and the walls of vessel 14.

Figure 8:
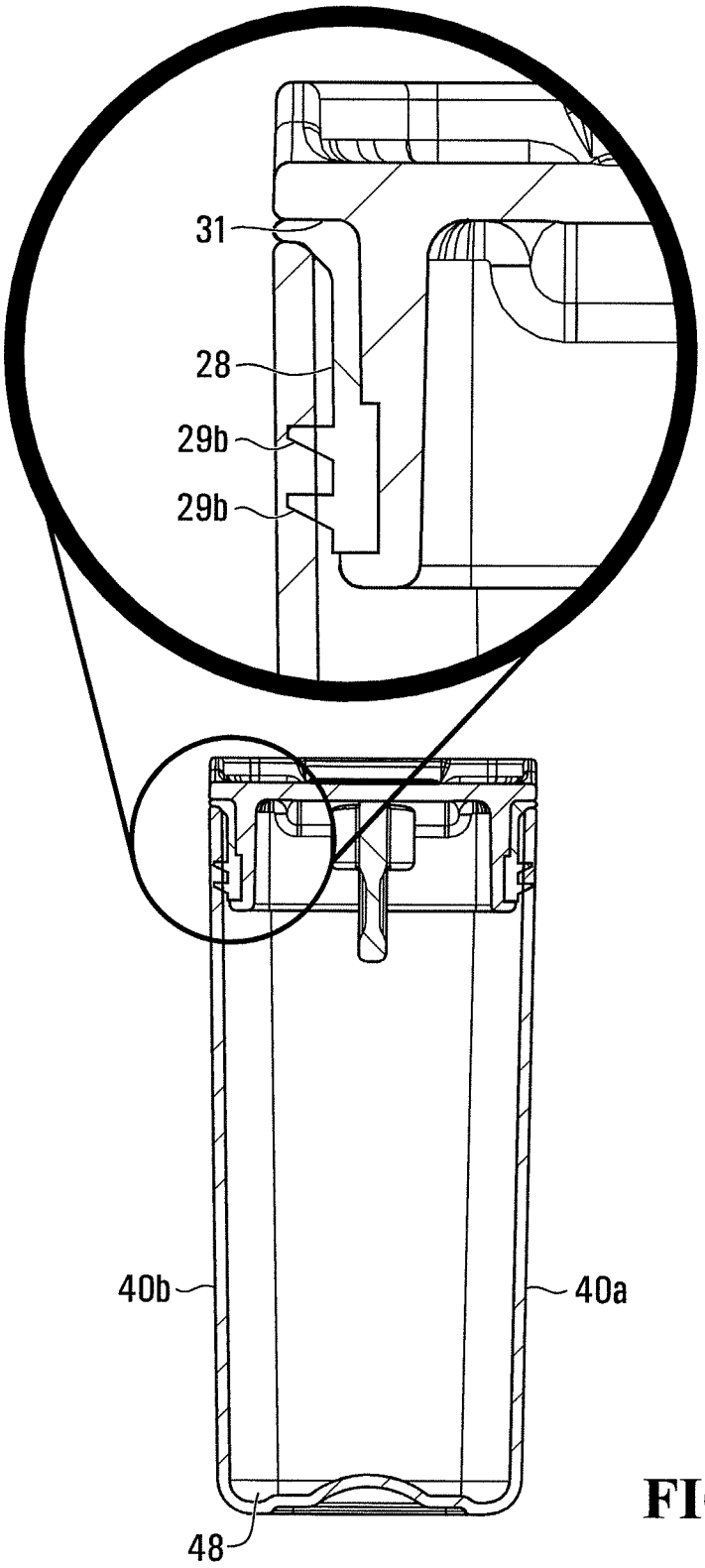
FIG. 8 is a cross sectional view of the drinking container of FIG. 1.

Seal 28 includes several (e.g. two) or more ribs 29*b*, that extend around the entire circumference of cap 12, and a further gasket 31 that rests beneath the top lip of cap 12. As illustrated in FIG. 8, gasket 31 of seal 28 is brought into abutment with the top ledge of vessel 14, once cap 12 is placed atop vessel 14.

Cap 12 is depicted as removed from vessel 14 in FIGS. 4A-4B. As illustrated, cap 12 may be formed from a single material—such as a soft/medium soft polymer, and includes a flat top surface 50; a dispensing opening 52; and air inlet 54. Dispensing opening 52 is generally circular, centered between the sides of cap 12, about ⅓ of the way between back and front of surface 50, along the length of cap 12. Dispensing opening 52 accommodates base 20 of drinking straw assembly 18, to allow it to be friction fit therein. Air inlet 54 is just beside dispensing opening 52. Air inlet 54 allows air to enter vessel 14 as liquid is depleted therefrom.

Cap 12 includes a base portion 62 of a hinge 100 that extends upwardly from the top surface 50 of cap 12, and provides opposed hinge pins 66*a*, 66*b* mounted on upwardly extending walls 68*a*, 68*b*. These pins 66*a*, 66*b* extend toward the left and right sides of cap 12, and define a hinge axis 64.

Cap 12 also includes an upwardly extending abutment surface 70 that abuts a complementary surface on lid 16 (described below), and urges lid 16 forward as described below.

Each of walls 68*a* and 68*b* include an upwardly extending front surface 72, that extends generally vertical, and a downwardly extending top surface 74 that extend from front surface 72, horizontally and at a downward angle of between about 2-25°, terminating in a cusp 76. Cusp 76 is generally pointed, but may be slightly rounded or bevelled. As will become apparent, cusp 76 serves as threshold, that once pushed past, may serve to lock lid 16 on cap 12 in its open position.

Protrusions 56*a* and 56*b* are found at the front and aft ends of cap 12 (as seen in FIG. 4B). Protrusion 56*a* is complementary in size and geometry to hole 58*a* on tab 42 of vessel 14 (FIG. 6). Protrusion 56*b* is complementary in size and geometry to an hole 58*b* on tab 44 of vessel 14. Protrusion 56*b* is mounted on an upwardly extending, flexible tab 55.

The overall height of cap 12 is about 25 mm. Cap 12 may also be formed using known molding techniques—and may be formed as a single formed piece.

As illustrated in cross-section in FIGS. 3A-3D, drinking opening 52 may be contoured to aid in retaining base 20 of drinking straw assembly 18. Moreover, air inlet 54 may open into a void 59 formed beneath the top surface 50 of cap 12. A rubber valve (not shown) may be placed atop the bottom open of inlet 54 within void 59.

Figure 5A:
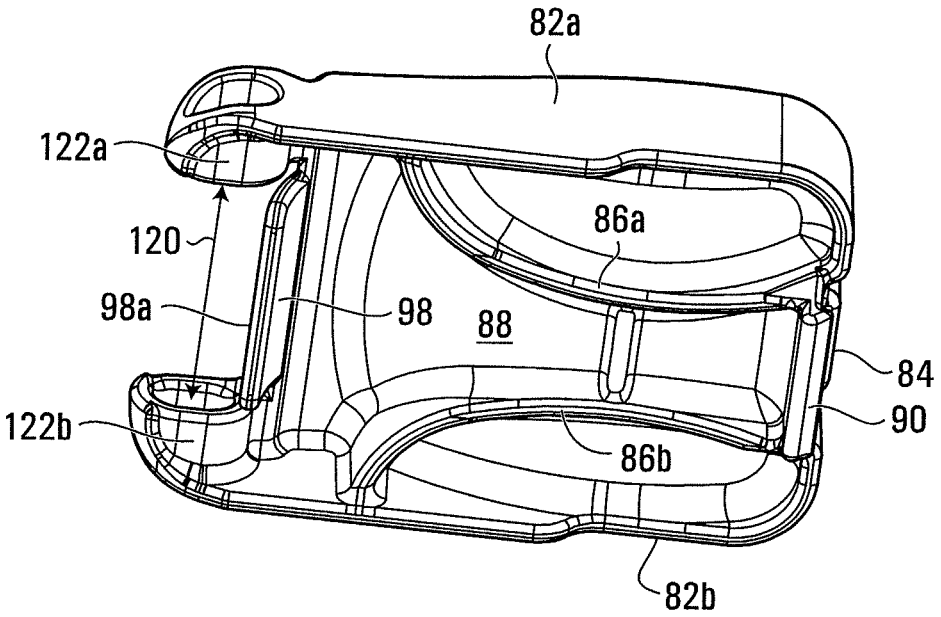
FIGS. 5A-5B are perspective views of a lid of the drinking container of FIG. 1.
Figure 5B:
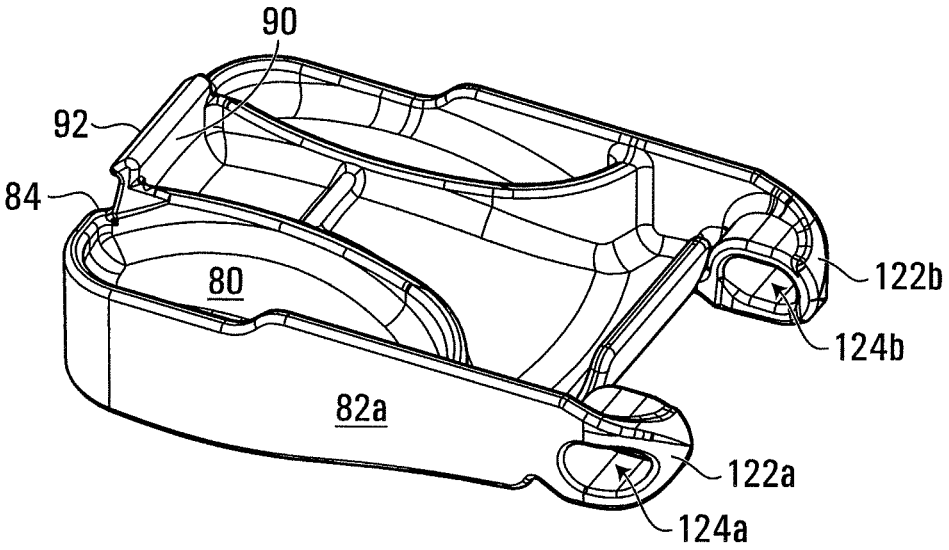

Lid 16 is depicted in isolation with a portion of straw assembly 18 in FIGS. 5A-5B. Lid 16 includes a generally top surface 80, and opposing side walls 82*a*, 82*b* extending downwardly therefrom. Top surface 80 may be bevelled, or flat, or have any other suitable contour. Lid 16 further includes a forward end wall 84, extending downward from surface 80. Extending from the bottom of forward end wall 84 is a locking tab 90. Locking tab 90 includes a forward protrusion 92, complementary to a locking slot or opening 94 (FIG. 4A) on the interior of cap 12. Forward protrusion 92 is in the form of a hook.

As further illustrated in FIG. 5A, the underside of lid 16 includes spaced rails 86*a*, 86*b*. The depicted rails 86*a*, 86*b* are generally arcuate, with the convex side of the two rails opposing each other, partially forming a passageway 88 there between. The narrow most portion of passageway 88 corresponds to the trough of each of arcuate rails 86*a*, 86*b*, and is sized to be slightly larger than the outer diameter of flexible straw 22, to guide and engage flexible straw 22 as lid 16 is brought into its closed position. The height of rails 86*a*, 86*b* is several millimetres.

A further tab 98 extends downwardly from the bottom of flat surface 80, at a slight rearward angle (e.g. between 2° and 5°). Tab 98 provides an abutment surface 98*a*, that contacts an abutment surface of cap 12, as described below. Tab 98 may be formed as a thin (e.g. 1-2 mm) piece of material—for example having dimensions of 20 mm×20 mm. As will be appreciated, such dimensions allow tab 98 to flex resiliently.

Lid 16 is pivotally mounted to the top of cap 12 and seals flexible straw 22 to container 10, by way of hinge 100.

Lid 16 includes female hinge portion 120 of hinge 100. Female hinge portion 120 includes two opposed sockets 122*a* and 122*b*, each including an oblong opening 124*a*, 124*b* respectively. Sockets 122*a*, 122*b* respectively engage pins 66*a* and 66*b*.

Sockets 122*a* and 122*b* are spaced from each other to accommodate walls 68*a* and 68*b* of cap 12 therebetween. Tolerances are sufficient so that sockets 122*a* and 122*b* are pushed outwards by walls 68*a*, 68*b*, so that the resiliency of the material used to form lid 16 causes sockets 122*a*, 122*b* to be naturally biased toward walls 68*a*, 68*b* to engage pins 66*a*, 66*b*, as for example viewed in FIG. 1. At the same time, sockets 122*a*, 122*b* are appropriately spaced from each other to allow lid 16 to pivot on pins 66*a*, 66*b*, when seated within openings 124*a* and 124*b*.

Openings 124*a*, 124*b* may be formed oblong—for example, formed generally as ovals—for example as elipses, or as generally rectangular openings with rounded ends. Other shapes will be apparent to those of ordinary skill. The width of openings 124*a*, 124*b* is about that of pins 66*a*, 66*b*. Pins 66*a*, 66*b* may thus slide backward and forward within openings 124*a*, 124*b*, allowing slight forward and backward movement or play, of lid 16 on cap 12.

Lid 16 may also be formed of a polymer or other suitable material, using known molding techniques—and may be formed as a single formed piece.

Operation of drinking container 10 may best be appreciated with reference to FIGS. 2A-2D, 3A-3D, and 7. Vessel 14 is typically filled with a liquid (not shown). Straw assembly 18 is placed into cap 12 and lid 16 is placed thereon to form a sub-assembly, with lid 16 closed. Seal 28 may also be placed around cap 12.

The sub-assembly of cap 12, lid 16, straw assembly 18 and seal 28 may then be placed within the top opening of vessel 14, until protrusion 56*a* mates with hole 58*a*, and protrusion 56*b* mates with hole 58*b*. Seal 28 seals cap 12, and protrusions 56*a* and 56*b* lock cap 12 in place on vessel 14. Lid 16 may be closed as viewed in FIGS. 2A and 3A.

The assembled drinking vessel 10 is viewed in cross-section in FIGS. 3A-3D.

Pressing tab 55 urges protrusion 56*b*, forward, away from hole 58*b*, as illustrated in FIG. 7, allows cap 12 to again be removed from vessel 14, by pulling on the rear of cap 12.

Figure 2A:
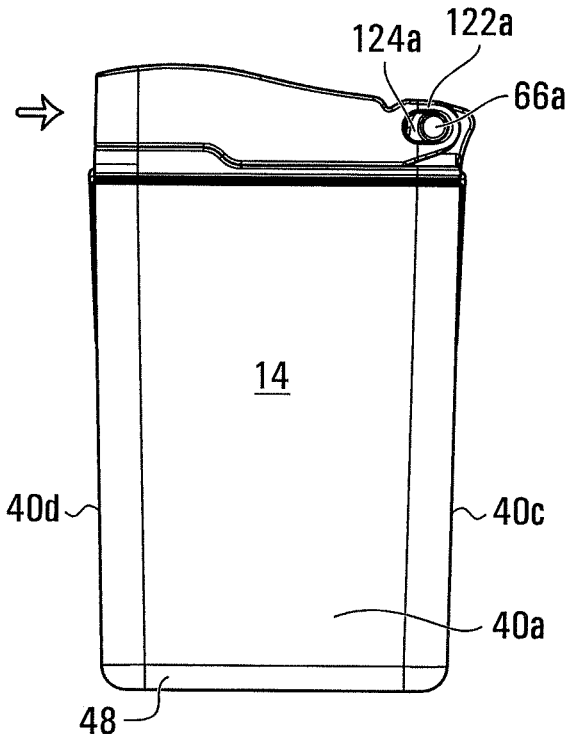
FIG. 2A is a right side view of the drinking container of FIG. 1, with lid closed.

As noted, lid 16 may be moved and pivoted from a closed position to an open position, illustrated in FIGS. 2A-2D and 3A-3D. In its closed position as shown in FIG. 2A, lid 16 is retained on cap 12, through the interaction of locking tab 90, with slot 94. Abutment surface 98*a* on tab 98 of lid 16 further tensions lid 16 in place. Specifically, downwardly extending tab 98, against abutment surface 70 urges lid 16 slightly forward toward the front of vessel 14. Tab 98 acts as a camming surface, pushing lid 16 forward on pins 66*a*, 66*b*. Tab 98 is also somewhat resilient and naturally biases lid in the forward direction. This, in turn urges locking tab 90 into engagement with the inner surface of cap 12. Locking tab 90, once so engaged, prevents lid 16 from returning to its open position.

Lid 16 in its closed position, causes flexible straw 22 to be flexed into the passageway 88 between the bottom surface of lid 16 defined by rails 86*a*, 86*b* of cap 16. Flexible straw 22 is further bent forward to cover air inlet 54. Moreover, in this closed position, flexible straw 22 may be pinched by being bent forward, and shielded from dirt by lid 16. Rails 86*a*, 86*b* along with the bottom surface of lid 16 and wall 80 thus form a cavity between the bottom of lid 16 and top surface 50 of cap 12 that receives and shields straw 22. Straw 22, in the meantime, is naturally biased to urge lid 16 upward.

Figure 2B:
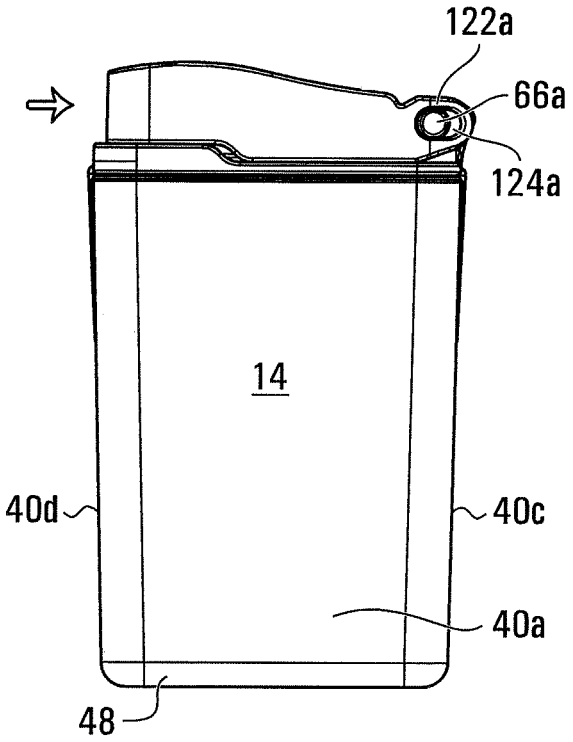
FIG. 2B is a right side view of the drinking container of FIG. 1, with its lid being urged for opening.
Figure 2C:
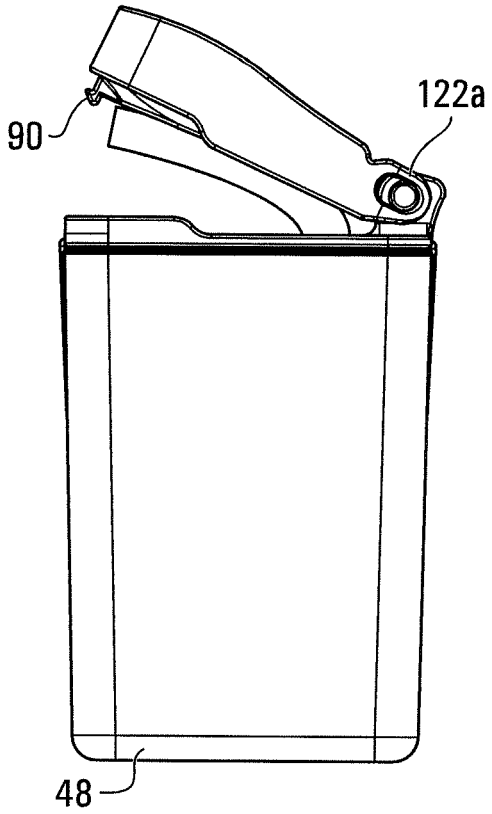
FIGS. 2C-2D are right side views of the drinking container of FIG. 1, with lid opened.
Figure 2D:
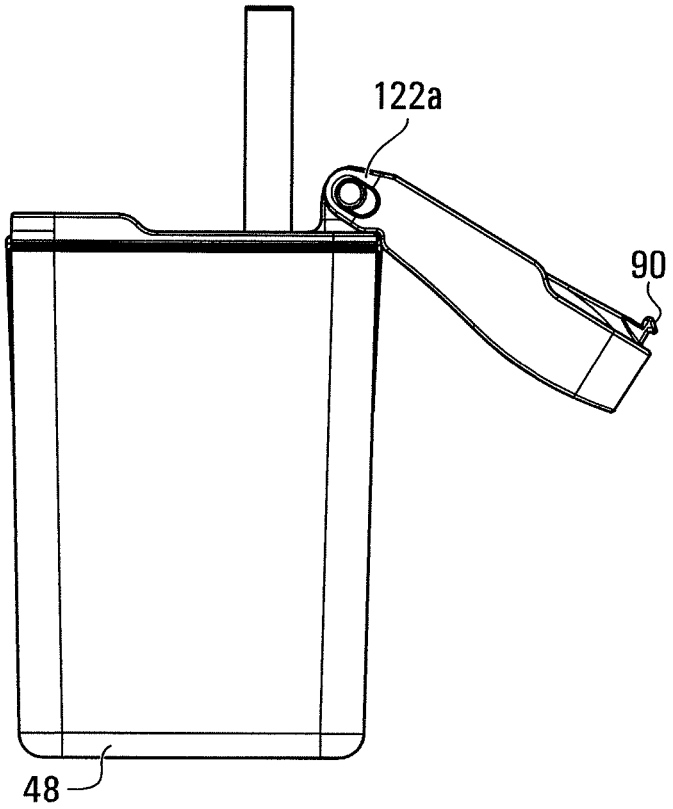

Pressing against the front of lid 16, as illustrated in FIGS. 2A-2B and 3A-3B, urges lid 16 backward on pins 66*a*, 66*b* (aided in part by the oblong shape of openings 124*a*, 124*b*), causing lid 16 to slide backward on base 12, as illustrated in FIG. 2B. This sliding motion releases locking tab 90 from tight engagement with the inner surface of cap 12, and opening 94. Flexible straw 22, biased upward, then urges lid 16 upward, to pivot toward its open position.

Lid 16 may be further pivoted open manually. As tab 98 passes over the top of wall 68*a*/68*b*, it may be moved past cusp 76. Cusp 76 acts as a threshold over which tab 98 is urged to move lid 16 to its fully open position (e.g. pivoted beyond about 155° from its closed position), through application of additional force. Without application of additional force in the opposite direction, tab 98 will remain on the traversed side of cusp 76, and cusp 76 effectively retains lid 16 in its open position. Put another way, an applied manual force is required to move tab 98 over cusp 76.

Once lid 16 is open, and out of the way of flexible straw 22, the natural flex/bias of flexible straw 22 causes it to extend upwardly for drinking. As well, air inlet 54 is now unobstructed.

Lid 16 may be closed by pivoting it forward, over cusp 76. Abutment surface 98*a* in contact with abutment surface 70, as the lid is pivoted from its open position to its closed position urges lid 16 forward on pins 66*a*/66*b*, and thus tab 98 forward as lid 16 is pivoted to its closed position Conveniently lid 16 can become dislodged from cap 12 and removed by urging sockets 122*a*, 122*b* outward toward the left and right edges of cap 12.

Of course, the above described embodiments are intended to be illustrative only and in no way limiting. The described embodiments are susceptible to many modifications of form, arrangement of parts, details and order of operation. The invention is intended to encompass all such modification within its scope, as defined by the claims.

What is claimed is:

1. A drinking container comprising a vessel;

a cap, atop said vessel;

a lid;

a hinge located proximate a rear of said lid and interconnecting said cap to said lid, to allow said lid to pivot on said cap between a closed and open position, said hinge comprising at least one pin mounted in an oblong opening in said lid;

a locking tab at the front of said lid, that engages with an inner surface of said cap, to retain said lid in said closed position;

a first abutment surface on said cap; and a second abutment surface on said lid, wherein said first and second abutment surfaces are arranged to contact with each other as said lid is pivoted from said open position to said closed position, and wherein contact of said first and second abutment surfaces urges said lid and said tab forward as said lid is pivoted to said closed position and wherein said locking tab is released from said cap when said lid is in said closed position, by urging said lid backwards relative to said cap, causing said oblong opening to slide backward on said pin.

2. The container of claim 1, wherein said second abutment surface extends downwardly and toward the rear of said lid.

3. The container of claim 2, wherein said first abutment surface extends generally vertically.

4. The container of claim 1, wherein said oblong opening allows said pin to be slid away in said opening, thereby moving a pivot axis of said cap.

5. The container of claim 1, wherein said cap and said lid define a cavity in said lid, and further comprising a resilient straw in said cavity in said lid and in flow communication with an interior of said vessel.

6. The container of claim 5, wherein said resilient straw urges said lid to its open position.

7. The container of claim 1, wherein said locking tab comprises a hook.

8. The container of claim 7, further comprising an opening in said lid to receive said hook.

9. The container of claim 1, wherein said lid is formed of unitary injection molded plastic.

10. The container of claim 1, said cap is formed of unitary injection molded plastic.

11. The container of claim 1, wherein said cap comprises a rearward extending protrusion for locking said cap on said vessel, and wherein said vessel comprises a complementary socket for receiving said protrusion.

12. The container of claim 11, wherein said protrusion extends from a resilient tab, on a rear wall of said cap.

13. A drinking container lid assembly comprising a cap;

a lid;

a hinge located proximate a rear of said lid and interconnecting said cap to said lid, to allow said lid to pivot on said cap between a closed and open position; and a locking tab at the front of said lid, that is urged forward to engage with an inner surface of said cap, to retain said lid in said closed position, wherein said hinge comprises at least one hinge pin mounted in an oblong opening in said lid to allow pivoting of said lid from said closed position to said open position, and wherein said locking tab is disengaged from said cap by sliding said lid backwards on said cap, causing said pin to move forward in said oblong opening.

14. The drinking container lid assembly of claim 13, further comprising a seal that extends around a periphery of said cap, said seal comprising at least one rib, and a gasket.

15. The drinking container lid assembly of claim 14, wherein said cap and said lid define a cavity, and further comprising a resilient straw extending from said cavity, to urge said lid upwardly.

* * * * *